US006312295B2

(12) United States Patent
Nishimatsu

(10) Patent No.: US 6,312,295 B2
(45) Date of Patent: Nov. 6, 2001

(54) ELECTRICAL CONNECTOR

(75) Inventor: Norimasa Nishimatsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/768,164

(22) Filed: Jan. 24, 2001

(30) Foreign Application Priority Data

Feb. 9, 2000 (JP) ..... 12-031374

(51) Int. Cl.[7] ..... H01R 13/502
(52) U.S. Cl. ..... 439/700; 439/862; 439/660
(58) Field of Search ..... 439/700, 660, 439/862

(56) References Cited

U.S. PATENT DOCUMENTS 5,904,597 * 5/1999 Doi et al. ..... 439/660
6,048,228 * 4/2000 Aso ..... 439/862
6,077,130 * 6/2000 Hughes et al. ..... 439/862
6,200,167 * 3/2001 Aso ..... 439/660

* cited by examiner

*Primary Examiner*—Tho D. Ta
(74) *Attorney, Agent, or Firm*—Kanesaka & Takeuchi

(57) ABSTRACT

A plurality of contact elements 14 are arranged in a housing 13 such that the contact sections 14A are exposed in the front end of the housing. The contact element 14 has a flexible section 14C provided in slot 12, and a slant section 14D connecting the contact section 14A to the flexible section 14C to make the contact section 14A movable in the first direction. A projection member 21 is provided on the housing to move the contact section 14A in the second direction perpendicular to the first direction.

13 Claims, 6 Drawing Sheets

ELECTRICAL CONNECTOR

BACKGROUND OF THE INVENTION

1. Field of the Invention

The present invention relates to an electrical connector having a contact element that is moved rearwardly by the mating contact element when it is plugged into a mating connector.

2. Description of the Related Art

An electrical connector of this type is disclosed in Japanese patent application Kokai No. 6-20737. A pair of connectors each have a housing and a contact element with a contact section exposed in the front end of the connector. One of the connectors has a flexible section so that when it is plugged with the other connector, the contact element is brought into contact with and moved rearwardly by the mating contact element. Consequently, the contact sections are electrically connected to each other under a contact pressure.

It is desired that the contact sections be clean and have low contact resistance. The conventional contact sections abut against each other only in the plugging direction, failing to provide the so-called "wiping effect." The contact elements produce too little amounts of sliding contact to provide satisfactory wiping effects.

SUMMARY OF THE INVENTION

Accordingly, it is an object of the invention to provide an electrical connector capable of providing large wiping effects upon plugging.

According to the invention there is provided an electrical connector comprising a housing having a front opening; at least one connector element provided in the housing which has a contact section provided in the front opening for contact with a mating contact element, a flexible section making the contact section movable in a first direction, and a slant section between the contact and flexible sections; and a projection member for moving the contact section in a second direction perpendicular to the first direction when the contact section is moved in the first direction by the mating contact element.

When it is plugged to a mating connector, the contact section is brought into contact with the contact section of the mating connector in the plugging direction and the contact element is flexed to permit the contact section to move rearwardly. When the contact section is moved rearwardly, it received forces from the projection member in the second direction perpendicular to the plugging direction and moved in the second direction to produce large sliding movement relative to the mating contact section. Thus, it provides large wiping effects.

The contact element has a bend in a plane including the first and second directions. The slant section engages with the projection member when the contact section is moved in the first direction. The bends are made asymmetrical. The bends are opposed in the second direction to offset reactive forces produced by the wiping effects. The contact elements are arranged alternately in opposite directions to offset the reactive forces evenly across the connector.

DESCRIPTION OF THE PREFERRED EMBODIMENTS

Embodiments of the invention will now be described with reference to the accompanying drawings.

Figure 1:
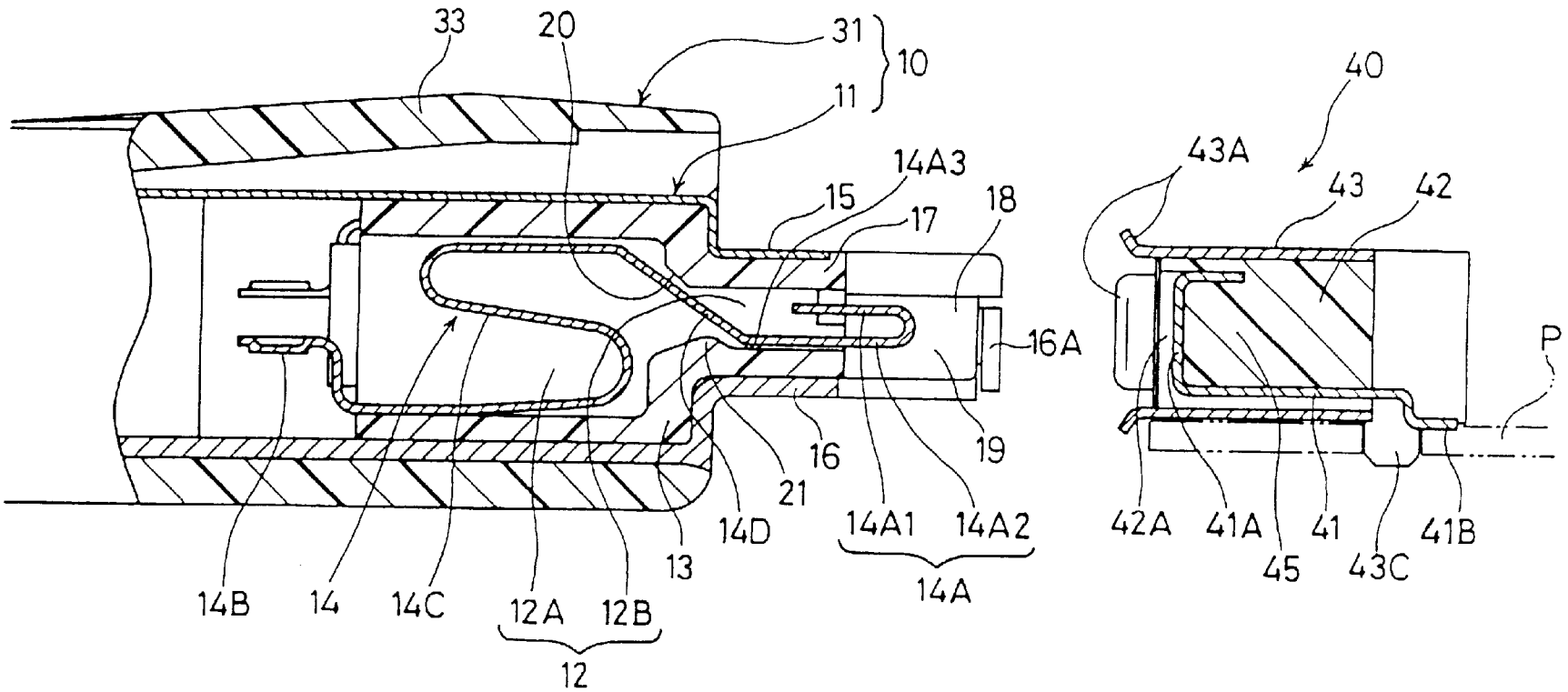
FIG. 1 is a sectional view of an electrical connector according to an embodiment of the invention prior to plugging into a mating connector.

In FIG. 1, a pair of connectors 10 and 40 are plugged with each other. The connector 40 is mounted on the circuit board P of electronic equipment. The connector 10 is plugged into the connector 40. The width of the connectors 10 and 40 is made greater than their height. The connector 10 comprises a connector body 11 and a cover member 31. The connector body 11 comprises a housing body 13 having a plurality of slots or elongated cavities 12, a plurality of contact elements 14 provided in the elongated cavities 12, and a pair of shield plates 15 and 16 provided upper and lower faces of the housing body 13.

The elongated cavities 12 are arranged at intervals in a direction perpendicular to the sheet and receive the contact elements 14; one in each elongated cavity. The housing body 13 has a reduced plugging section 17 for plugging into the mating connector 40 so that each elongate cavity 12 has a wider cavity section 12A and a narrower cavity section 12B. A tapered edge 20 and a raised edge 21 are provided at upper and lower edges between the wider and narrower cavity sections 12A and 12B. The tapered edge 20 guides the slant section 14D of a contact element 14. The contact section 14A of a contact element 14 has a U-shaped form, one leg of which has a free end 14A1 and the other makes a straight section 14A2 which communicates with the slant section 14D. The raised edge 21 is provided at such a position as to lift the straight section 14A2 when the straight section 14A2 is moved rearwardly. A projection 14A3 provided at an end of the straight section 14A2 is pressed against a wall of the narrower cavity section 12B to determined an initial contact point.

A pair of protruded sections 18 extend forwardly from opposite sides of the housing body 13 to define a recessed space 19. The protruded sections 18 also serve to guides when the connector is plugged into the mating connector 40. The lower shield plate 16 is made thicker than the upper shield plate 15 to provide more strength.

Figure 2:
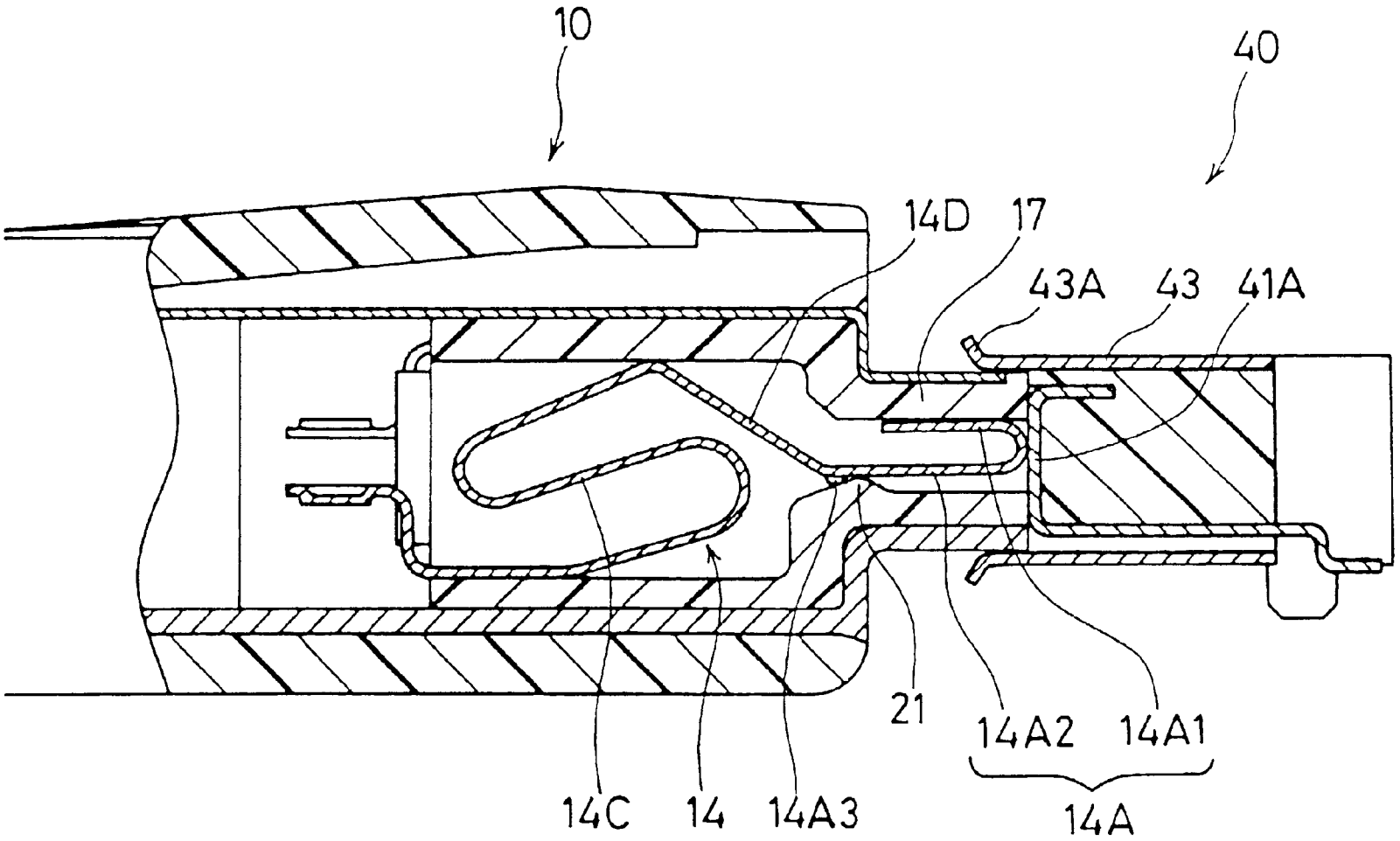
FIG. 2 is a sectional view of the electrical connector plugged into the mating connector.

Each contact element 14 has a U-shaped contact section 14A, a connection section 14B projecting rearwardly from the housing body 13, an S-shaped flexible section 14C, and a slant section 14C to connect the flexible section 14C and the contact section 14A. The front portion of each contact section 14A normally projects into the recessed space 19 but, when the connector 10 is plugged into the mating connector 40, the front end of the contact section 14A is moved backwardly by the contact element of the mating connector to a position which is flush with the bottom of the recessed space 19 (FIG. 2). The slant section 14D is moved rearwardly along with the contact section 14A because of the flexible section 14C. That is, the flexible section 14C makes the contact and slant sections 14A and 14C movable. The contact sections 14A of all of the contact elements 14 are arranged within the recessed space 19.

The connector 40 comprises a housing body 42, a plurality of contact elements 41, and a shield plate 43. The housing body 42 has a pair of recesses (not shown) on opposite sides thereof to receive the protruded sections 18 of the connector 10. A raised section 45 is provided between the recesses to support the contact sections 41A of the contact elements 41. When the raised section 45 is put into the recessed space 19, the contact sections 41A are brought into contact with the contact sections 14A of the connector 10.

The shield plate 43 surrounds the housing body 42 to provide outer side walls of the recesses. It has a front edge that extends forwardly beyond the front face of the raised section 45 and flares to provide a guide portion 43A. A plurality of grooves 42A are provided in the front face of the raised section 45 to receive the contact sections 41A of the contact elements 41. As best shown in FIG. 2, the front face of each contact section 41A is sufficiently high and wide to make contact with the contact section 14A of the mating connector. The width and depth of each groove 42A are made such that the front face of the connector 10 does not make any contact with the contact sections 41A.

The rear portion of each contact element 41 projects rearwardly from the housing body 42 to provide a connection section 41B which is soldered to a corresponding trace of the circuit board P. The shield plate 43 has a pair of legs 43C, which are put into corresponding holes of the circuit board P and soldered for connection.

The use of the connectors will be described below.

(1) The connector 40 is attached to the circuit board P that is provided within equipment.

(2) The cables of other equipment are soldered to the connection sections of respective contact elements 14 for the connector 10.

(3) As shown in FIG. 2, the plug section 18 of the connector 10 is plugged into the connector 40 such that the protruded sections 18 of the connector 10 are guided by the guide section 43A of the shield plate 43 into the recesses of the connector 40.

(4) When the plugging is completed, the contact sections 14A of the contact elements 14 are moved rearwardly by the contact sections 41A, with the flexible sections 14C flexed, and brought into contact with the contact sections 41A under a predetermined contact pressure. Since the projections 14A3 pass the raised edge 21 and the straight sections 14A2 ride on the raised edge 21, the contact sections 14A also are moved upwardly. That is, the contact sections 14A slide on the contact sections 41A of the mating connector to produce "wiping effects". The raised edge 14A3 helps to increase the range of sliding movement.

Figure 3:
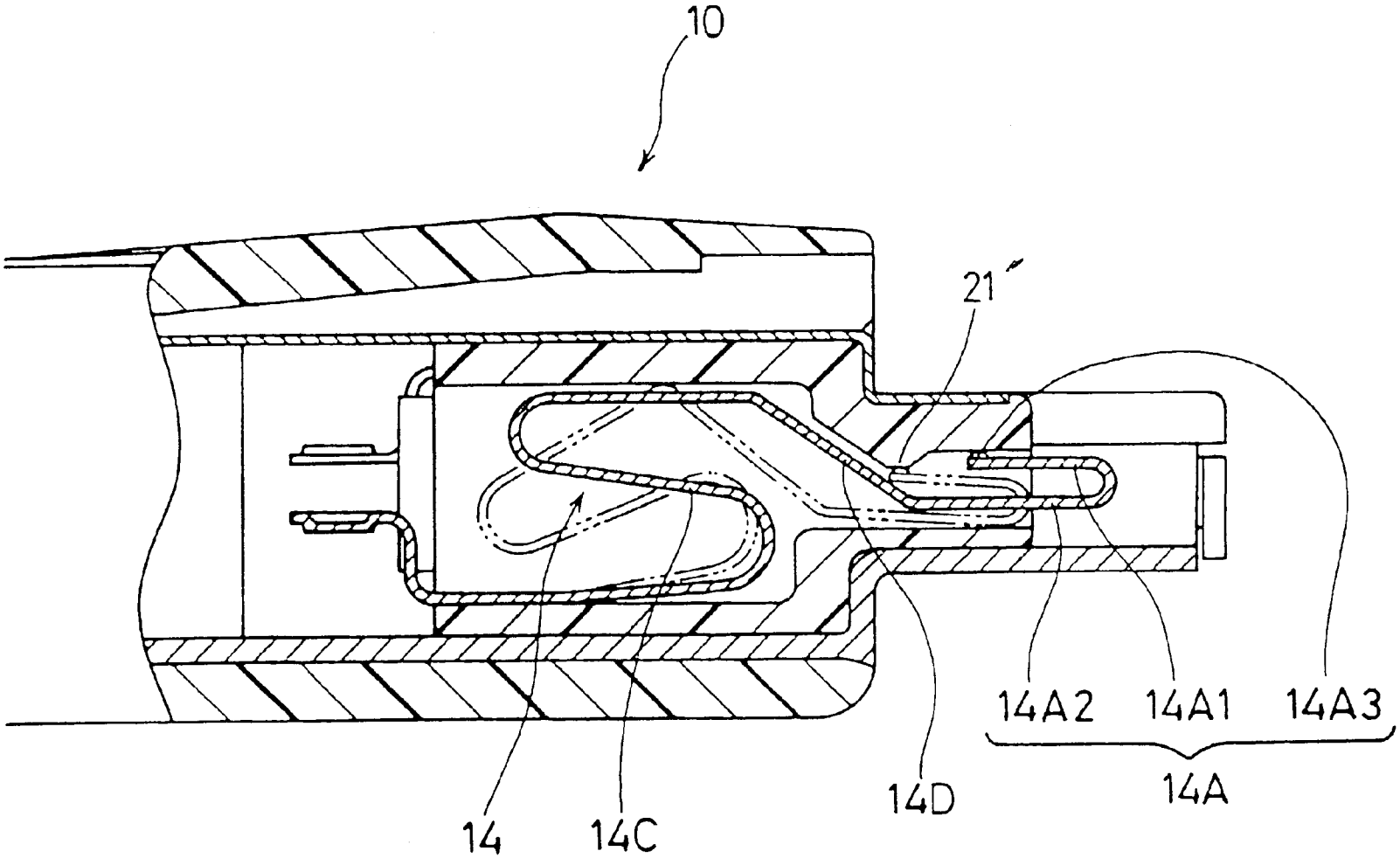
FIG. 3 is a sectional view of an electrical connector according to another embodiment of the invention.

In FIG. 3, in this embodiment, the raised edge 21 is replaced by raised edge 21' provided on the upper edge between the sloped face 20 and the protruded section 17, and the free ends 14A1 of the contact sections 14A is provided with a projection 14A3, which rides on the raised edge 21' when the contact section 14A is moved rearwardly.

Figure 4:
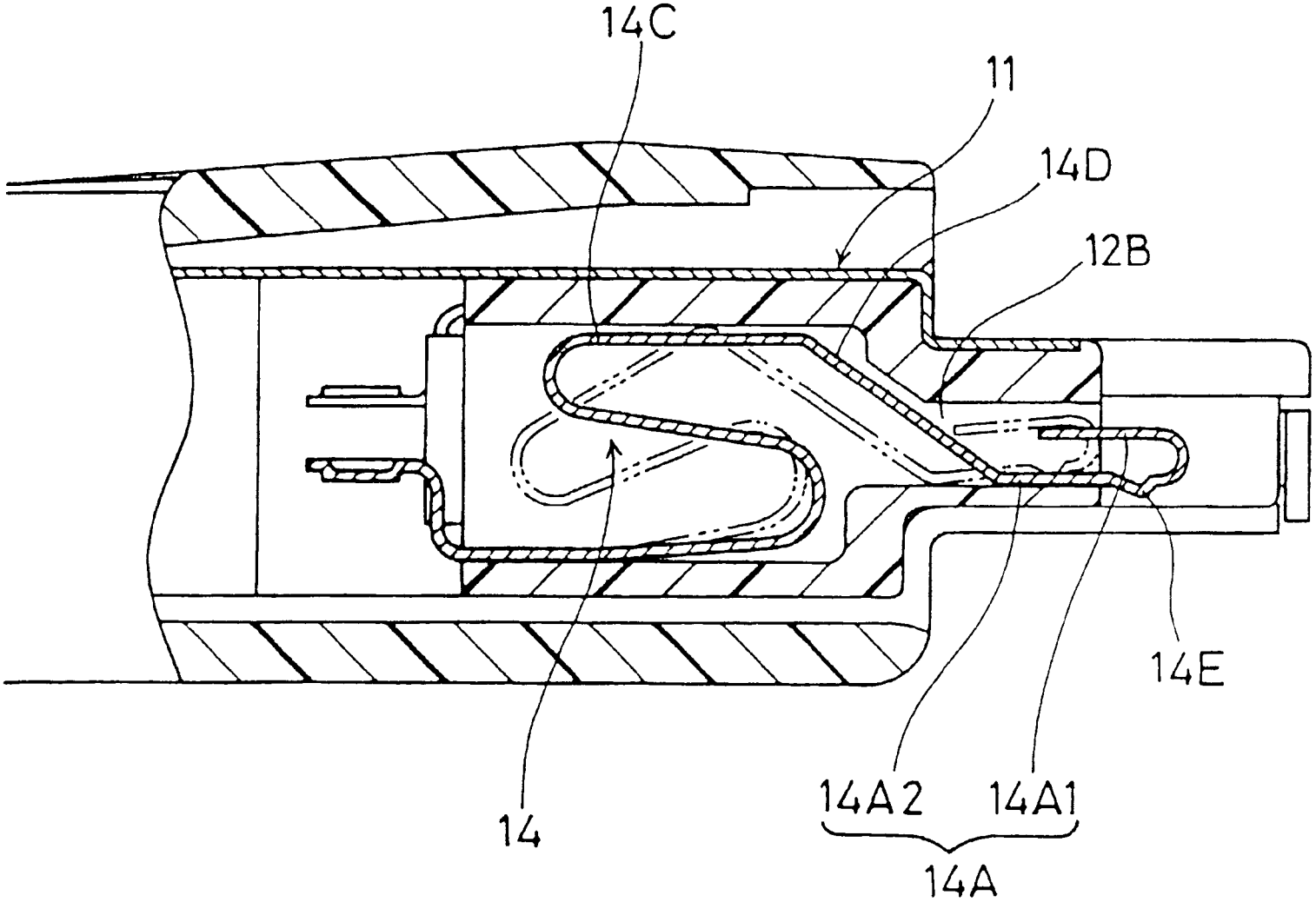
FIG. 4 is a sectional view of an electrical connector according to still another embodiment of the invention.

In FIG. 4, the inside wall of the narrow cavity section 12B opposed to the straight section 14A2 of the contact element 14 is made flat, and a projection 14E is provided on the straight section 14A2. When the contact section 14A of the contact element 14 is moved rearwardly, the projection 14E rides on the bottom wall of the narrow cavity section 12B to lift the contact section 14A upwardly. The section of the projection 14E closer to the narrow cavity section 12B is sloped slowly so as to facilitate rearward movement of the contact element 14.

Figure 5:
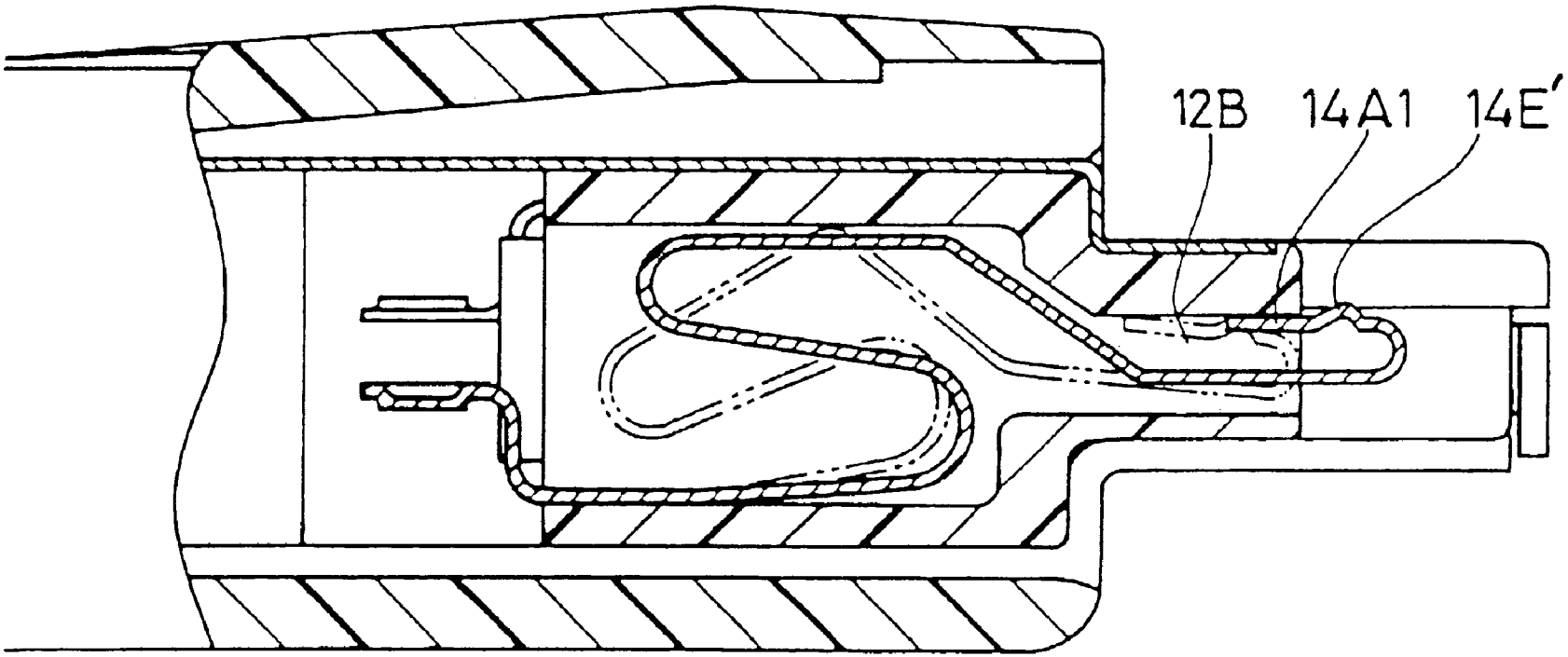
FIG. 5 is a sectional view of an electrical connector according to yet another embodiment of the invention.

In FIG. 5, a projection 14E' is provided on the free end 14A1 of the contact section 14A to abut against the inside wall of the narrow cavity section 12B when the contact section 14A is moved rearwardly.

In the embodiments of FIGS. 4 and 5, the inside walls of the narrow cavity section 12B are made flat, making molding of the housing body easy.

Figure 6:
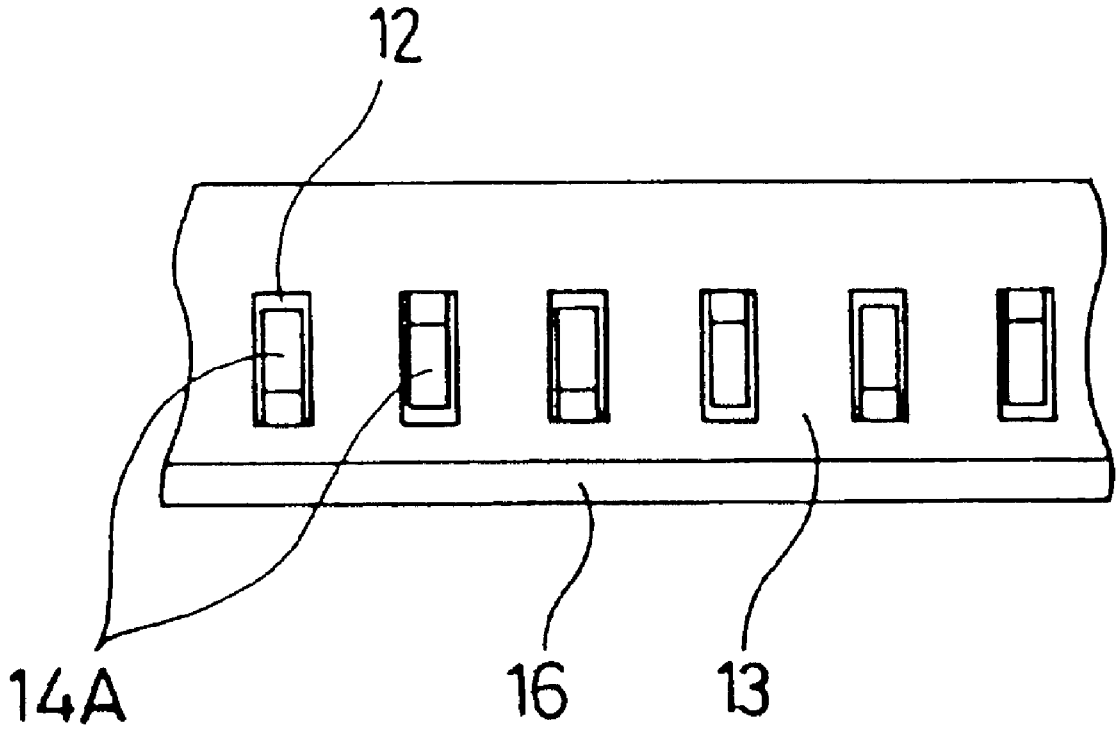
FIG. 6 is a front view of an electrical connector according to another embodiment of the invention.

It is desired that the friction forces of a plurality of contact elements be zero. Thus, a half of contact elements are arranged on the upper row in a direction and the other half on the lower row in the opposite direction so as to offset the friction forces and provide wiping effects. As shown in FIG. 6, the contact sections of contact elements are arranged alternately in opposite directions so that the friction forces are offset evenly across the width of the connector. Alternatively, the raised edges of the housing may be provided on opposite sides. For example, the raised edges of FIGS. 2 and 3 are formed alternately.

As has been described, according to the invention, raised edges or projections are provided on the housing or contact elements to exert forces on the movable sections in a direction perpendicular to the rearward movement of the movable sections of the contact elements so that when the contact sections are brought into contact with the mating contact sections, the movable sections moved by the raised edges or projections produce large sliding movement at the contact sections, increasing the wiping effects.

What is claimed is:

1. An electrical connector comprising:

a housing having an elongated cavity consisting of a front narrower cavity section and a rear wider cavity section;

at least one contact element provided in said housing, said contact element having a contact section projecting from said front narrower cavity for contact with a mating contact element, a free end section extending from one of ends of said contact section, a straight section extending from the other end of said contact section, a slant section extending from said straight section, and at least one flexible section extending from said slant section and making said contact, free end, straight and slant sections movable in a first direction; and a raised edge provided on a wall of said housing between said front and rear cavity sections such that said free end section or straight section rides on said raised edge of said housing so that said contact section moves on a second direction perpendicular to said first direction when said contact section is moved rearwardly in said first direction by said mating contact element.

2. An electrical connector according to claim 1, said straight section or said free end section has a projection at an end portion thereof, which is pressed against an inner wall of said front narrower cavity section to determine an initial contact position.

3. An electrical connector according to claim 2, said projection rides on said raised edge of said housing so that said contact section is further moved in said second direction.

4. An electrical connector according to claim 1, wherein said contact element has at least one bend in a plane including said first and second directions.

5. An electrical connector according to claim 4, wherein said bends are asymmetrical.

6. An electrical connector according to claim 5, wherein said bends are opposed in said second direction.

7. An electrical connector according to claim 6, wherein said contact elements are arranged alternately in opposite directions.

8. An electrical connector comprising:

a housing having a cavity consisting of a front narrower cavity section and a rear wider cavity section;

at least one contact element provided in said housing and having a contact section projecting from said front narrower cavity for contact with a mating contact element, an free end section extending from one of ends of said contact section, a straight section extending from the other end of said contact section, and at least one flexible section extending from said straight section and making said contact, free end and straight sections movable in a first direction; and a projection provided in said straight section or free end section in vicinity of said contact section such that said projection rides on an end portion of a wall defining said front narrower cavity so that said contact section moves in a second direction perpendicular to said first direction when said contact section is moved rearwardly in said first direction by said mating contact element.

9. An electrical connector according to claim 8, wherein said projection has a slope on a side facing said front cavity.

10. An electrical connector according to claim 8, wherein said contact element has at least one bend in a plane including said first and second directions.

11. An electrical connector according to claim 10, wherein said bends are asymmetrical.

12. An electrical connector according to claim 11, wherein said bends are opposed in said second direction.

13. An electrical connector according to claim 12, wherein said contact elements are arranged alternately in opposite directions.

* * * * *